United States Patent [19]

Weiner

[11] Patent Number: 4,819,820

[45] Date of Patent: Apr. 11, 1989

[54] CARGO CONTAINERS

[75] Inventor: Ronald Weiner, East Brighton, Australia

[73] Assignee: TCS Containers Pty. Ltd., Australia

[21] Appl. No.: 137,536

[22] PCT Filed: Feb. 20, 1987

[86] PCT No.: PCT/AU87/00049

§ 371 Date: Oct. 21, 1987

§ 102(e) Date: Oct. 21, 1987

[87] PCT Pub. No.: WO87/04994

PCT Pub. Date: Aug. 27, 1987

[30] Foreign Application Priority Data

Feb. 21, 1986 [AU] Australia ..... PH4725

[51] Int. Cl.[4] ..... A44B 21/00

[52] U.S. Cl. ..... 220/1.5; 220/23.4

[58] Field of Search ..... 220/1.5, 4 D, 19, 23.4

[56] References Cited

U.S. PATENT DOCUMENTS

| | | | |
|---|---|---|---|
| 3,061,134 | 10/1962 | Fesmire et al. | 220/23.4 X |
| 3,711,902 | 1/1973 | Eggert, Jr. | 220/1.5 X |
| 3,823,972 | 7/1974 | Ramer | 220/1.5 X |
| 3,872,555 | 3/1975 | Link et al. | 220/1.5 X |
| 4,088,238 | 5/1978 | Berwald et al. | 220/1.5 |
| 4,108,326 | 8/1978 | Bertolini | 220/1.5 |
| 4,695,184 | 9/1987 | Robishaw et al. | 220/23.4 X |

*Primary Examiner*—Steven M. Pollard

*Attorney, Agent, or Firm*—Diller, Ramik & Wight

[57] ABSTRACT

A cargo container (1) and a coupling assembly (13) for releasably coupling two or more of those containers (1) together in a side-by-side relationship. The assembly (13) has a male and female coupling part (14,15). The male coupling part (14) has a mounting structure (16) for mounting that part (14) on a container corner (12). A connecting element (25) is carried by the mounting structure (16) and retained for limited linear movement between a projected position projecting from the mounting structure (16) and a retracted position. The female coupling part (15) also has a mounting structure (31) for mounting that part (15) on an adjacent corner (12) of another container (1). That structure (31) provides a receiving recess (34) that can be aligned with the connecting element (25) so as to receive the element (25) when in the projected position. A locking element (40) positively secures the connecting element (25) to the female coupling part (15) when received in the receiving recess (34) so as to releasably couple the coupling parts (14,15) together.

12 Claims, 2 Drawing Sheets

CARGO CONTAINERS

This invention relates generally to cargo storage and transportation, and in particular to a container in which cargo is stored and transported. The container may be a shipping container for national and international transportation of cargo, and it will be convenient to hereinafter describe the invention in relation to that example application. It is to be appreciated, however, that the invention is not limited to that application.

The use of large regular hexahedral shaped metal containers for holding cargo has generally revolutionised international transportation of that cargo, particularly shipping where those containers can be stacked on open ship decks and readily transferred between those decks and road vehicles to facilitate rapid flow of cargo between suppliers and receivers. Those containers are required to be of standard dimensions and be constructed to certain standards to facilitate their handling, stacking, and storage.

For economies of transportation each standard container should be transported full of cargo which may be provided by a single supplier having a full container load (FCL) or a number of suppliers each having less than a container load (LCL). An FCL may be rapidly transported between a supplier who loads the container and a receiver who unloads the container without any intermediary cargo loading or unloading. However, each LCL necessitates additional handling since the cargo is loaded into a standard container at a cargo consolidation depot and then unloaded from that container at a cargo deconsolidation depot. This additional handling adds to the cargo shipping time and costs, and generally negates advantages otherwise provided by containerisation.

In an effort to alleviate this additional handling "mini" containers have been devised for holding small cargo loads. In this way, each mini container can be filled with an LCL and shipped between suppliers and receivers without intermediary cargo handling. To overcome the problem that these mini containers ar smaller than the standard container and thus in themselves unacceptable, a number of the mini containers are locked together at the consolidation depot to form a single standard container for shipment, and then separated at the deconsolidation depot for fowarding to separate receivers.

Various arrangements have been developed for locking these mini containers together. One such arrangement involves separate linking devices which lock into juxtaposed twist lock corner castings of adjacent mini containers to hold the containers together. Being separate from the containers they are prone to misplacement and loss when not in use. Moreover, those devices are generally of a complicated construction and may not function satisfactorily over a period of time, particularly after exposure to harsh environments, unless meticulously maintained.

Another arrangement involves a separate base frame on which a set of mini containers is positioned and each container individually locked to that frame. Again, however, being separate from the containers increases a likelihood that the base frame will be misplaced or lost when not in use, or at least may present difficulties in monitoring its location when not in use.

It is an object of the present invention to alleviate these disadvantages through the provision of a relatively simple coupling assembly for securing these mini containers together. A further object is the provision of simple mini container which can be coupled together in sets to form a standard container.

With these objects in mind, the present invention provides in one aspect a coupling assembly for releasably coupling cargo containers together in a side-by-side relationship, including: a male coupling part having a mounting structure for mounting that part on a container and a connecting element carried by the mounting structure and retained for limited linear movement relative thereto between a projected position projecting from the mounting structure and a retracted position; a female coupling part having a mounting structure for mounting that part on another container, the female coupling part mounting structure providing a receiving recess that can be aligned with the connecting element so as to receive the connecting element when in the projected position; and, a locking element for positively securing the connecting element to the female coupling part when received in the receiving recess thereby to releasably couple the coupling parts thereto.

In another aspect, the present invention provides a cargo container having a pair of oppositely facing sides against which other similar cargo containers can be placed in a side-by-side relationship, the container including: at least one male coupling part having a mounting structure for mounting that part on the container and a connecting element carried by the mounting structure and retained for limited linear movement relative thereto between a projected position projecting from the mounting structure and extending beyond the one container side and a retracted position; at least one female coupling part having a mounting structure mounting that part adjacent the other one of the container sides, the female coupling part providing a receiving recess opening on to the other one side, the coupling parts being arranged so that when the container and a similar container are placed side-by-side the connecting element of the male coupling part of the container aligns with the receiving recess of the female coupling part of the similar container, whereby the connecting element can be received in the receiving recess when in the projected position; and a locking element for positively securing the connecting element of the male coupling part of the container to the female coupling part of the similar container when received in the receiving recess thereby to releasably couple the coupling parts together.

This invention is described herein with reference to the container in a normal use orientation on a horizontally extending foundation, and terms such as "top" should be construed in the light of this orientation. However, it is to be appreciated that other orientations may be equally possible and that consequential changes in terms such as that above may be required in the light of those other orientations for a proper and complete understanding of the invention.

The connecting element is preferably elongate and movable along a longitudinal axis of the connecting element. The receiving recess is preferable also elongate for coaxially receiving that connecting element. The mounting structure of the male coupling part preferably defines a bore in which the connecting element is movably mounted. The connecting element preferably slides along the bore. In the projecting position the connecting element preferably extends longitudinally from the bore while in the retracted position is at least substantially contained within that bore. The connecting element may include a connecting bolt.

The male coupling part may have an access slot extending along and opening laterally into the bore. A handle portion of the connecting element can then extend from the bore through the access slot for gripping to manually move the connecting element.

The receiving recess is preferably shaped and sized to closely, slidably receive the connecting element therein. That recess has an open end through which the connecting element passes into the recess. There may be, a lead-in region adjacent that open end to facilitate entry of the connecting element into the receiving recess. In that regard, the female coupling part mounting structure may have a guide face flaring outwardly from the open end of the receiving recess and against which the connecting element may abut during movement toward the receiving recess: This guide face and connecting element then coact as a cam and follower to guide the connecting element to the open end of the recess Preferably, the female coupling part mounting structure has a locking aperture that extends at least substantially transversely of the line of movement of the connecting element. In addition, the connecting element preferably has a locking aperture that aligns with the locking aperture of the female coupling part mounting structure. In this way, when the connecting element is received in the receiving recess, the locking element is inserted into the aligned locking apertures. This prevents connecting element removal from the receiving recess. The locking element may include a locking pin slidably insertable into and removable from the aligned locking apertures.

In the example application, the coupling parts are mountable at corner regions of respective cargo containers. In that regard four male coupling parts may be mounted one each at respective corner regions of the one container side, while four female coupling parts may be mounted one each at respective corner regions of the other container side.

The following description refers to a preferred embodiment of the cargo container and coupling assembly of the present invention. To facilitate an understanding of the invention, reference is made in the description to the accompanying drawings where the container and assembly are illustrated. It is to be understood that the invention is not limited to the embodiment as hereinafter described and as illustrated.

Figure 1:
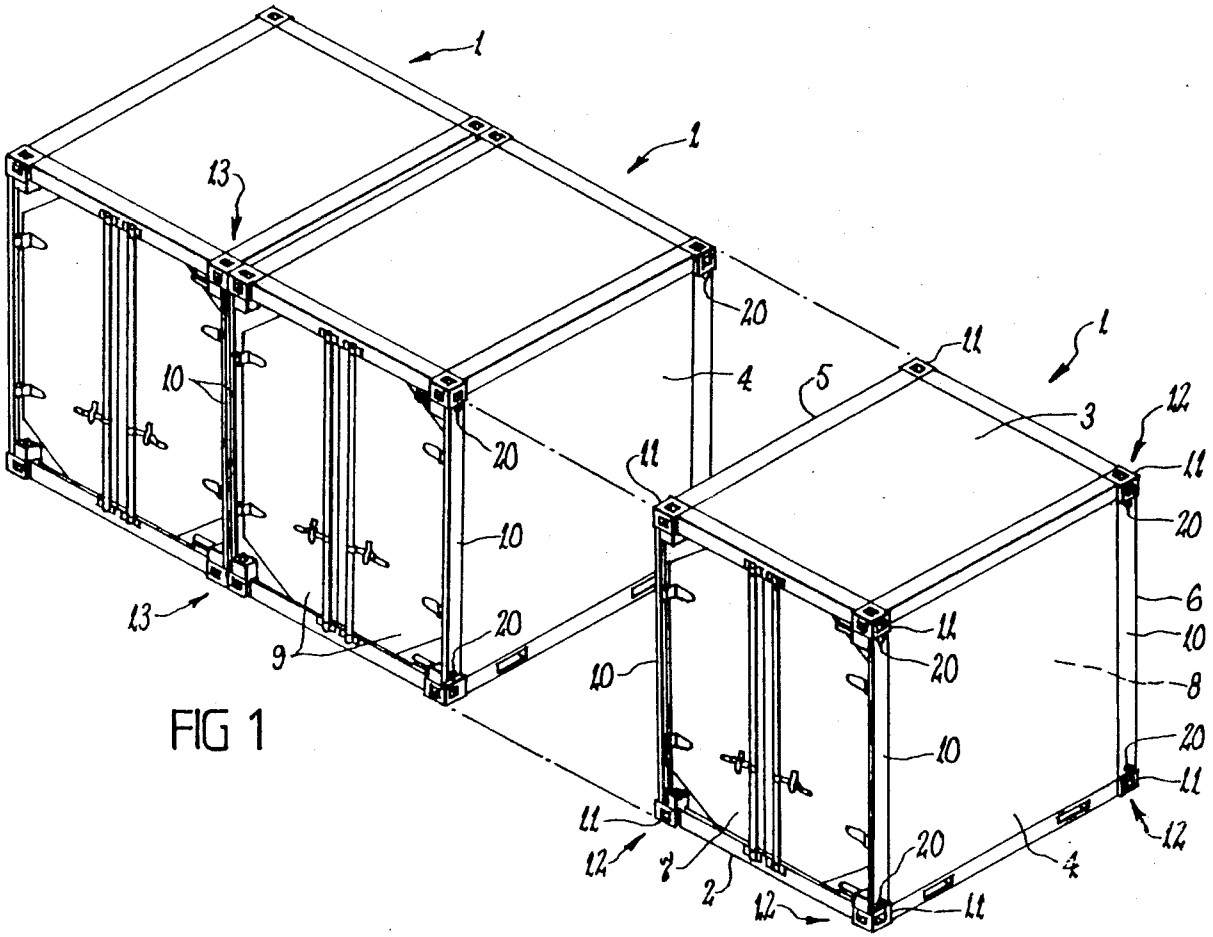
FIG. 1 is a perspective view of a set of three cargo carrying containers according to a preferred embodiment of the present invention.

Referring initially to FIG. 1 there is generally illustrated a set of three cargo carrying containers 1. These containers 1, may take on any suitable construction having regard to their intended application. In the example application containers 1, may be "mini" cargo containers having dimensions of about 7 foot 4 inches long by 8 foot wide by 8 foot 6 inches high so that a set of three containers when arranged side-by-side form one standard container of about 20 foot long by 8 foot wide by 8 foot 6 inches high. Other than its size the mini container may be of a similar construction to a conventional standard container so as to meet the requirements of container regulatory bodies. Moreover, each container 1, may be of an identical construction.

In that regard, each mini container 1, may have base wall 2, top wall 3, and pairs of side walls 4, 5 and end walls 6, 7 extending therebetween to define cargo holding space 8. At least one of the side and/or end walls 4, 5, 6, 7 (wall 7 as illustrated) provides one or more doors 9, for access to space 8. Side and end walls 4, 5, 6, 7 lie between corner posts 10, each extending between base wall 2, and top wall 3 and provide strengthened upright corners to the container. Moreover, conventional container corner castings 11, can be located at each of the eight corner junctions 12, between walls 2, 3, 4, 5, 6, 7, to receive twist locks or other locking devices (not illustrated) for securing container 1, during transportation.

Containers 1, can be releasably coupled together side-by-side i.e. with side walls 4, 5 of adjacent containers 1, being in juxtaposed facing relationship as illustrated by two of the containers 1, in FIG. 1. That is achieved through a series of coupling assemblies 13. A total of four such assemblies 13, are used to coupled each pair of containers 1, together each assembly 13, being located in respective container corner junctions 12, adjacent the juxtaposed and oppositely facing side walls 4, 5. One coupling assembly 13, is illustrated in detail in FIGS. 2 and 3, and it should be appreciated that all assemblies 13, are of identical construction although some will be of reverse image configuration depending on their location in the container.

Figure 2:
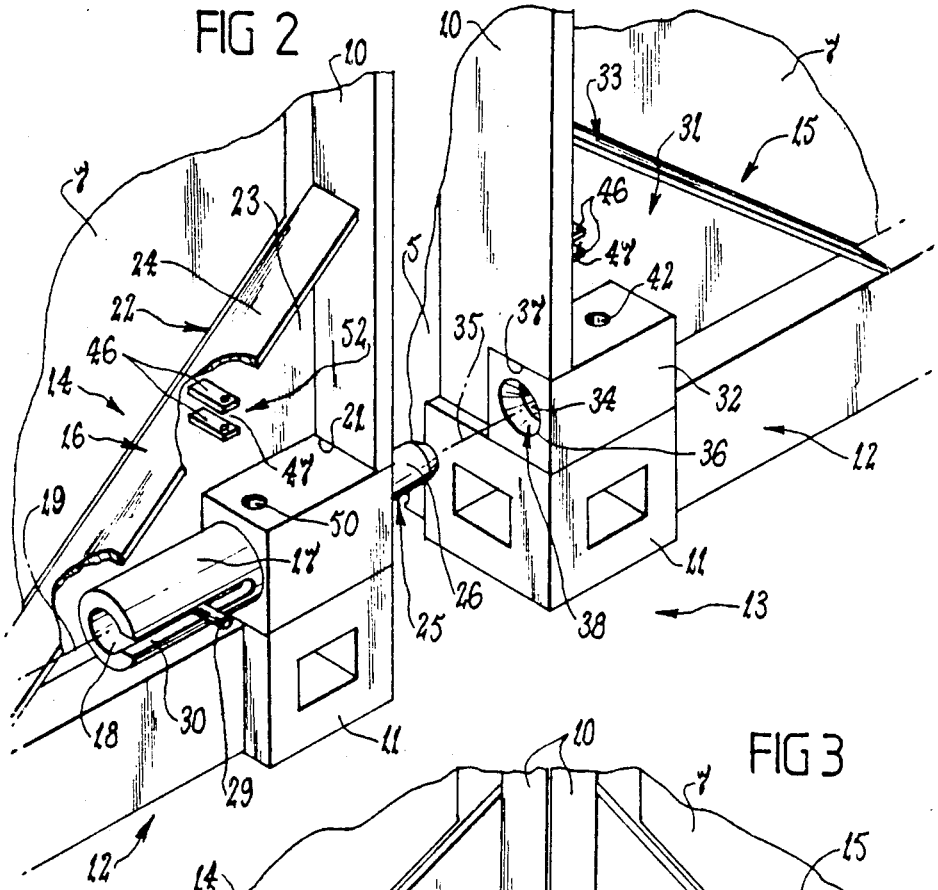
FIG. 2 is a perspective view of corner regions of two uncoupled containers of FIG. 1 showing a coupling assembly according to the present invention.
Figure 3:
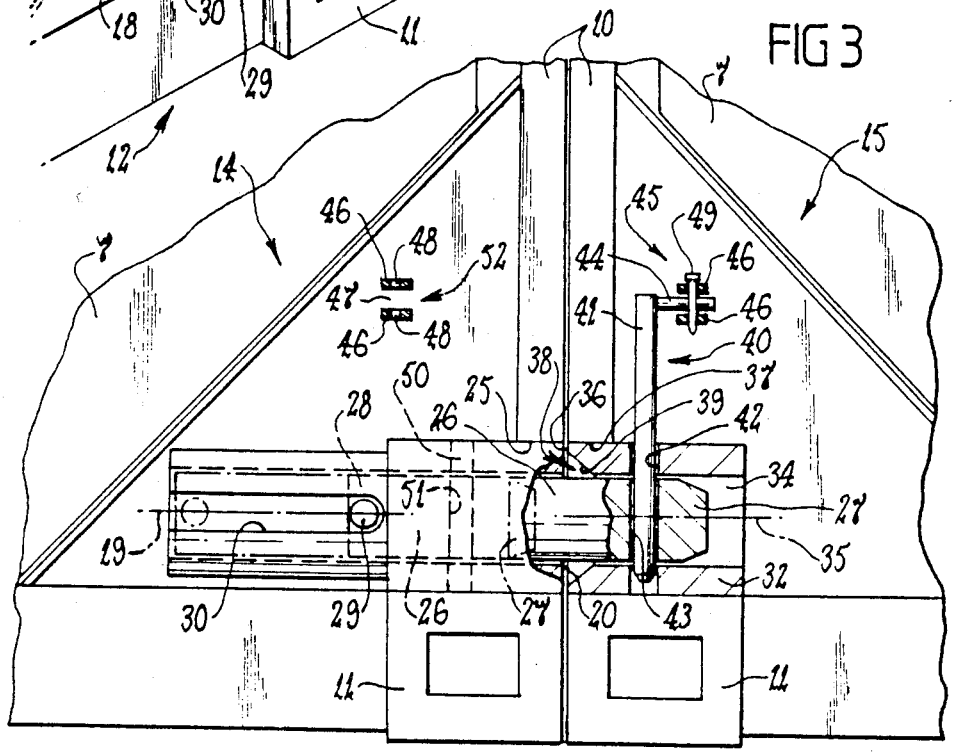
FIG. 3 is a front view, partially in section, of the corner regions of FIG. 2 but with the two containers coupled together with the coupling assembly.

Referring no to FIGS. 2 and 3 coupling assembly 13, includes male coupling part 14, mounted in a corner junction 12 of one container 1, and female coupling part 15, mounted in an adjacent corner junction 12, of another container 1.

Male coupling part 14, includes mounting structure 16, for rigidly mounting part 14 in corner junction 12. Mounting structure 16, includes elongate body 17, having bore 18, extending therethrough. Bore 18, lies on axis 19, which extends perpendicular to adjacent side wall 4. Moreover, bore 18, terminates in open end 20 adjacent corner post 10, which has opening 21, therein so as to provide free access to and from bore 18, through open end 20.

Bore 18, is of circular cross-sectional shape although it is to be appreciated that other shapes may be equally suitable.

Body 17, may be formed from metal material, and in that regard may be an iron casting (as illustrated) or a steel plate fabrication (not illustrated).

Mounting structure 16, also includes reinforcing gusset 22, extending across corner junction 12, between side wall 4 and adjacent top or bottom wall 2, 3 passed body 17. Gusset 22, generally strengthens corner junction 12. In addition gusset 22 protects body 17, from damage during container use yet permits access to body 17. Gusset 22, includes web portion 23, extending behind body 17, so as to expose body 17 for access to manipulate assembly 13. Integral flange portion 24, projects laterally from web portion 23, so as overlie body 17. Typically gusset 22, will be formed from metal plate, such as steel plate.

Body 17, and gusset 22, may be conveniently welded in position in container 1.

Male coupling part 14, also includes connecting element 25, carried by body 17, for limited linear movement relative thereto along longitudinal axis 19. In particular, connecting element 25, is constrained to move between a projected position (as illustrated by full line in FIG. 3) and a retracted position (as illustrated by chain-dot line in FIG. 3).

Connecting element 25, includes connecting bolt 26, located in bore 18, for sliding movement therealong. Bolt 26, is of the same cross-sectional shape as bore 18, and to that end may be circular (as illustrated). Connecting bolt 26, has opposite leading end region 27, and trailing end region 28, leading end region 27, leading during bolt projection from bore 18, through open end 20, whilst trailing end region 28, is permanently retained within bore 18. Leading end region 27, may be tapered (as illustrated), rounded or otherwise shaped to facilitate coupling as will become more apparent hereinafter.

Connecting bolt 26, is manually slidable between the projected and retracted positions. To facilitate that movement connecting element 25 also includes handle portion 29, mounted on connecting bolt 26, and accessible externally of body 17, for manual gripping. To that end, body 17 is provided with access slot 30 extending line therefrom through slot 30. Handle portion 29 is manually accessible at end wall 6 or 7, adjacent male coupling part 14. The access slot 30, may be of a finite selected length by being closed or blocked at each end thereof so that when handle portion 29, abuts each end thereof connecting bolt 26, is in a respective one of its projected and retracted positions. That abutment also acts to retain bolt 26 against complete removal from bore 18.

Female coupling part 15, also includes mounting structure 31, which includes elongate body 32, and gusset 33, through which coupling part 15, is rigidly mounted in corner junction 12, of an adjacent container 1.

Body 32, has receiving bore 34, extending therethrough and lying on axis 35, extending perpendicular to adjacent side wall 5. Axis 35, and axis 19, will be co-aligned for and during coupling of parts 14, 15 together. Bore 34, terminates in open end 36, which in a similar manner to open end 20, of bore 18, is adjacent corner post 10, having opening 37, therein so as to provide free access to and from bore 34, through open end 36. Connecting bolt 26, is receivable through open end 36, into receiving bore 34, and to that end bore 34 is generally of a complimentary shape and size to bolt 26, so as to slidingly receive bolt 26, therein.

Body 32, provides lead-in region 38, adjacent open end 36, to facilitate entry of connecting bolt 26. In particular, lead-in region 38, accommodates any minor axial misalignment between retracted connecting bolt 26, and receiving bore 34 which otherwise might prevent bolt 26, being projected into bore 34. Lead-in region 38, may be provided by suitably shaping body 32, about receiving bore open end 36. To that end, body 32, may have guide face 39, flaring outwardly from open end 36, and against which leading end region 27 of bolt 26, may forcibly abut, guide face 39, and bolt 26, coacting in a cam and follower manner to relatively shift coupling parts 14, 15 until bolt 26 and receiving bore 34, align along axes 19 and 35. Tapering or rounding of leading end region 27, may facilitate that coaction that flaring may be at an angle of about 45° to axis 35.

Body 32, may be formed in the same manner as body 17. Gusset 33, may be of a similar configuration and construction as gusset 22.

Coupling assembly 13, also includes connecting element 40, for securing connecting bolt 26, to female coupling part 15, and in particular to body 32, thereof when bolt 26 is projected into bore 34. Thus, it is this connecting element 40, that completes rigid coupling between coupling parts 14, 15. Connecting element 40, is manually actuable and to that end is accessible at end wall 6 or 7, adjacent female coupling part 15.

Locking element 40 includes locking pin 41, insertable into apertures 42, 43, in body 32, and connecting bolt 26, respectively to engage and positively secure bolt 26 relative to female coupling part 15. Apertures 42, 43, extend transversely to longitudinal axes 35, and 19, respectively, and align to receive pin 41, when bolt 26, is in its projected position and completely received within receiving bore 34. Apertures 42, 43, are circular while pin 41, is cylindrical in shape.

To free bolt 26 for retraction from bore 34, pin 41, is simply removed from at least bolt aperture 43; pin 41, 42, 43. Locking pin 41, is slidably insertable and removable from apertures 42, 43.

Locking element 40, also includes tang 44, projecting laterally from pin 41. Tang 44, permits ready manipulation of pin 41, during insertion in and retraction from apertures 42, 43.

Locking pin 41, is positively retained in aligned apertures 42, 43 against accidental removal. To that end, female coupling part 15, may further include retraining catch 45, for pin 41. Retaining catch 45 may be of any suitable construction, and may include a pair of spaced apart retaining lugs 46, mounted on gusset 33, one above the other so as to define recess 47, therebetween. Lugs 46, are arranged so that when pin 41, is received in apertures 42, 43 pin 41, can be rotated about its longitudinal axis until tang 44, is received in recess 47. Lugs 46, have holes 48, therein for receiving a removable retaining pin 49, in order to retain tang 44, in recess 47.

In this preferred form, locking pin 41, or an auxiliary locking pin (not illustrated) may also positively secure connecting bolt 26, in its retracted position. In this way, bolt 26, is held out of the way when not in use coupling containers 1, together, for example when individual containers 1, are being stored or transported. This locking pin 41, may be selectively insertable into apertures 50, in body 17, and aperture 43, in connecting bolt 26. Like apertures 42, 43 these apertures 43, 50, extend transversely to longitudinal axis 19, and align to receive pin 41, when bolt 26, is in its retracted position.

Locking pin 41, or an auxiliary locking pin may also positively secure connecting bolt 26, relative to body 17, in its protected position. With bolt 26, held in that position coupling of parts 14, 15 may be facilitated. This locking pin 41, may be selectively insertable into apertures 50, in body 17, and aperture 51, in connecting bolt 26. These apertures 50, 51 may be like apertures 42,43, previously described. Locking pin 41, or an auxiliary locking pin may be retained in aligned apertures 43, 50 and 50, 51 against accidental removal and to that end male coupling part 14, also includes retaining catch 52, constructed and operated as with catch 45.

In coupling two containers 1, together, connecting bolts 26, of male coupling parts 14, on side wall 4, of one container 1, are moved to their projected position and secured with locking pins 41. Any locking pins 41, passing through apertures 42, in body 32, of female coupling part 15 are removed. The one container 1, is then maneouvered until the projecting connecting bolts 26, face and generally align with the respective receiving bores 34, in the other container 1. The one container 1, is then moved toward the other container 1 into a side-by-side relationship so that connecting bolts 26, approach and enter their respective receiving bores 34, any minor axial misalignment therebetween being corrected by coaction between leading end region 27, of bolts 26. and flared lead-in region 38 to receiving bores.

When containers 1, and in particular their corner posts 10, abut each other apertures 42, 43 align so that locking pins 41, can be inserted therein thereby coupling parts 14, 15, together. Upon insertion of those pins 41, they may be positively retained therein with retaining catches 45. The two containers 1, are thus coupled together.

It will be appreciated that the two containers may be uncoupled by reversing the above coupling procedure.

The coupling assembly of the present invention forms an integral part of containers intended to be coupled together. Because of this they are not prone to accidental separation from the containers and thus possible misplacement or loss. In any event, it is not necessary to continually monitor the whereabout of those assemblies because they are permanently retained on the containers.

The coupling assemblies are of a simple and robust construction yet function effectively to securely couple containers together. As such, the assemblies may be relatively inexpensive to manufacture and are not prone to break down or require regular maintenance.

Finally, it is to be appreciated that various modifications and/or alterations may be made to the coupling assembly and containers incorporating those assemblies without departing from the ambit of the present invention as defined in the claims appended hereto.

I claim:

1. A cargo container for carrying cargo alone as an individual container or to be rigidly connected to one or more other identical containers for handling together as a rigid container unit, the container including:

a top wall, a bottom wall and a series of side walls;

corner castings located at each corner region formed between the walls;

a plurality of male coupling parts, each male coupling part having a mounting structure rigidly mounting that respective part adjacent one of the container side walls and providing an elongate mounting bore of substantial length opening therefrom, each male coupling part also having an elongate connecting element of substantial length slidingly mounted in a respective mounting bore for limited linear movement along a longitudinal mounting bore axis between a projected position projecting from the bore and extending beyond the one container side wall and a retracted position, the male coupling parts being located entirely within an outline of the container defined by the corner castings when the connecting elements are in the retracted position;

a plurality of female coupling parts, each female coupling part having a mounting structure rigidly mounting that respective part adjacent an opposite container side wall and providing an elongate receiving bore of substantial length opening therefrom, the female coupling parts also being located entirely within the outline of the container by the corner castings, the coupling parts being arranged so that, when the container and an identical container are placed with their opposing side walls in complete face-to-face relation and immediately adjacent one another, the connecting elements of the male coupling parts of the container co-axially align with respective receiving bores of the female coupling parts of the identical container, whereby the connecting elements are slidingly received in the receiving bores when linearly moved in the projected position, the connecting elements slidingly fitting in their respective mounting bores and receiving bores along generally the substantial lengths thereof and in the absence of any other means to hold the container side walls in the face-to-face relation and prevent shifting of the containers out of the relation; and locking elements for positively securing the connecting elements of the male coupling parts of the container to the female coupling parts of the identical container when received in the receiving bores thereby to releasably couple the coupling parts together and hold the containers rigidly together as a rigid container unit.

2. A container as claimed in claim 1, wherein each male coupling part mounting structure has an access slot extending along and opening laterally into the respective mounting bore, and each connecting element includes a handle portion extending from the mounting bore through the access slot for gripping to manually move the connecting element between the projected and retracted positions.

3. A container as claimed in claim 1, wherein each connecting element includes a connecting bolt having a leading end region that leads the bolt into the respective receiving bore, the leading end region being tapered to facilitate initial entry into the receiving bore.

4. A container as claimed in claim 1, wherein each receiving bore is shaped and sized relative to the respective connecting element to closely, slidably receive the connecting element therein.

5. A container as claimed in claim 1, wherein each receiving bore has an open end through which the respective connecting element passes into the bore, and each female coupling part mounting structure provided a lead-in region adjacent the open end to facilitate entry of the respective connecting element into the receiving bore.

6. A container as claimed in claim 5, wherein at each lead-in region the female coupling part mounting structure has a guide face flaring outwardly from the open end of the receiving bore and against which the respective connecting element may abut during movement toward the receiving bore, each respective guide face and connecting element coacting as a cam and follower respectively to guide the connecting element to the open end of the receiving bore.

7. A container as claimed in claim 1, wherein each female coupling part mounting structure has a locking aperture extending at least substantially transversely of the line of movement of the connecting element, and each connecting element has a locking aperture therein that aligns with the locking aperture of the respective female coupling part mounting structure when the connecting element is received in the receiving bore, the locking element being insertable into the aligned locking apertures to prevent connecting element removal from the receiving bore.

8. A container as claimed in claim 1, wherein each male coupling part mounting structure has one or more locking apertures extending at least substantially transversely of the line of movement of the connecting element and the connecting element has one or more locking apertures therein that align with the or a respecting locking aperture of the male coupling part mounting structure when the connecting element is in the retracted and/or projected position, the respective locking element being insertable into the aligned locking apertures to positively secure the male coupling part in that respective position.

9. A container as claimed in claim 8, wherein each locking element includes a locking pin slidably insertable into and removable from the respective aligned locking apertures.

10. A container as claimed in claim 1, wherein each male and female coupling part mounting structure also each includes a reinforcing gusset rigidly mounted to the container immediately adjacent the mounting structure bodies so as to reinforce the container in the region of the coupling parts.

11. A container as claimed in claim 9, wherein the coupling parts are mounted at the corner regions of the container, and the reinforcing gussets are triangular shaped so as to bridge across the corner regions passed the mounting structure bodies.

12. A container as claimed in claim 1, wherein four male coupling parts are provided one each at respective corner regions adjacent the one container side wall, and four female coupling parts are provided one each at respective corner regions adjacent an opposite container side wall.

* * * * *